US010088169B2

(12) United States Patent
Gelber et al.

(10) Patent No.: US 10,088,169 B2
(45) Date of Patent: Oct. 2, 2018

(54) COOKTOP APPLIANCE AND METHOD OF OPERATION

(71) Applicant: Haier US Appliance Solutions, Inc., Wilmington, DE (US)

(72) Inventors: Scott Michael Gelber, Athens, AL (US); William Hull Bicknell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 144 days.

(21) Appl. No.: 15/210,938

(22) Filed: Jul. 15, 2016

(65) Prior Publication Data

US 2018/0017265 A1 Jan. 18, 2018

(51) Int. Cl.

| | |
|---|---|
| ***H05B 3/68*** | (2006.01) |
| ***H05B 1/02*** | (2006.01) |
| ***F24C 7/08*** | (2006.01) |
| ***F24C 15/10*** | (2006.01) |
| *H05B 3/74* | (2006.01) |
| *H05B 3/20* | (2006.01) |

(52) U.S. Cl.

CPC ..... *F24C 7/088* (2013.01); *F24C 15/106* (2013.01); *H05B 3/20* (2013.01); *H05B 3/748* (2013.01)

(58) Field of Classification Search

CPC ..... F24C 15/106; F24C 7/088; H05B 3/20–3/24; H05B 3/74–3/748

USPC ... 219/443.1–468.2, 479–486, 490–495, 519

See application file for complete search history.

(56) References Cited

U.S. PATENT DOCUMENTS

| | | | | |
|---|---|---|---|---|
| 4,447,710 | A * | 5/1984 | McWilliams | H05B 1/0266 219/448.14 |
| 4,639,578 | A * | 1/1987 | Payne | G05D 23/24 219/448.12 |
| 5,171,973 | A * | 12/1992 | Higgins | H05B 3/742 219/457.1 |
| 6,118,106 | A * | 9/2000 | Scott | H05B 1/0266 219/412 |
| 7,109,448 | B2 | 9/2006 | Goranson | |
| 2002/0157541 | A1 | 10/2002 | Cheah et al. | |
| 2004/0195232 | A1 | 10/2004 | Wilkins | |
| 2016/0014846 | A1 | 1/2016 | Grunow et al. | |

* cited by examiner

*Primary Examiner* — Sang Y Paik

(74) *Attorney, Agent, or Firm* — Dority & Manning, P.A.

(57) ABSTRACT

A cooktop appliance and method of operation is provided. The cooktop appliance may include a user interface, a power source, a burner, a thyristor, and a relay switch. The power source may be operably connected to the user interface. The burner may include a first radiant heat element and a second radiant heat element electrically coupled in parallel to the power source. The thyristor may be operably connected to the user interface and electrically coupled in series between the power source and the first radiant heat element to control activation of the first radiant heat element. The relay switch may be operably connected to the user interface and electrically coupled in series between the power source and the second radiant heat element to control activation of the second radiant heat element.

15 Claims, 7 Drawing Sheets

COOKTOP APPLIANCE AND METHOD OF OPERATION

FIELD OF THE INVENTION

The present subject matter relates generally to cooktop appliances and methods for operating cooktop appliances.

BACKGROUND OF THE INVENTION

Some existing cooktop appliances include radiant heating elements for heating pots, pans, and other containers with food items therein. Generally, the radiant heating elements can be operated at various settings. For example, the radiant heating elements of some appliances can be operated at a low heat setting to simmer food items, or the radiant heating elements can be operated at a high heat setting to boil water or fry food items. When simmering certain food items, such as delicate cream sauce or tomato sauce, heat is preferably applied to such food items at a low and consistent power. The low and consistent power can prevent such food items from spattering, sticking and/or or discoloring when simmered.

In order to transition from low heat to high heat settings, certain existing cooktop appliances use one or more rudimentary switches to cycle on and off different portions of a radiant heating element. For instance, some radiant heating elements may be cycled on/off through one or more switches to achieve a relatively constant average temperature. However, such cycling may bring undesirable results.

In some instances, rapidly and/or frequently cycling the switches of a radiant heating element may limit the overall lifespan of the switches, since many switches have an expected lifetime defined by the number of cycles they are expected to perform. Moreover, extending duty cycles in such appliances can hinder or obstruct application of low, even heat to containers on the cooktop appliance. In particular, long duty cycles can cause relatively large temperature amplitudes in food items within the containers compared to shorter duty cycles. These switches fail to allow precise control over the heat output. In turn, cooking methods that require a precise level of temperature control, such as sous-vide steam cooking, are difficult to employ.

Accordingly, a cooktop appliance with a radiant heating element and features for providing precise heat control without unduly limiting the lifespan of the radiant heating element would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a cooktop appliance is provided. The cooktop appliance may include a user interface, a power source, a burner, a thyristor, and a relay switch. The power source may be operably connected to the user interface. The burner may include a first radiant heat element and a second radiant heat element electrically coupled in parallel to the power source. The thyristor may be operably connected to the user interface and electrically coupled in series between the power source and the first radiant heat element to control activation of the first radiant heat element. The relay switch may be operably connected to the user interface and electrically coupled in series between the power source and the second radiant heat element to control activation of the second radiant heat element.

In another aspect of the present disclosure, a cooktop appliance is provided. The cooktop appliance may include a user interface, a power source, a burner, a thyristor, and a relay switch. The power source may be operably connected to the user interface. The burner may include a radiant heat element electrically coupled to the power source. The relay control may be connected to the user interface, the relay control including a thyristor and a relay switch, the thyristor and the relay switch coupled in parallel between the power source and the radiant heat element to control activation of the radiant heat element.

In yet another aspect of the present disclosure, a method of operating a cooktop appliance is provided. The cooktop appliance may include a burner having a first radiant heat element, a second radiant heat element, a thyristor, and a relay switch. The first radiant heat element may be electrically coupled to the second radiant heat element in parallel. The thyristor may be electrically coupled in series to the first radiant heat element. The relay switch may be electrically coupled in series to the second radiant heat element. The method may include receiving an input signal from a user interface, determining a heating condition based at least in part on the input signal, and activating one or more of the relay switch to energize the second radiant heat element or the thyristor to energize the first radiant heat element. Activating one or more of the relay switch or the thyristor may be initiated according to the determined heating condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
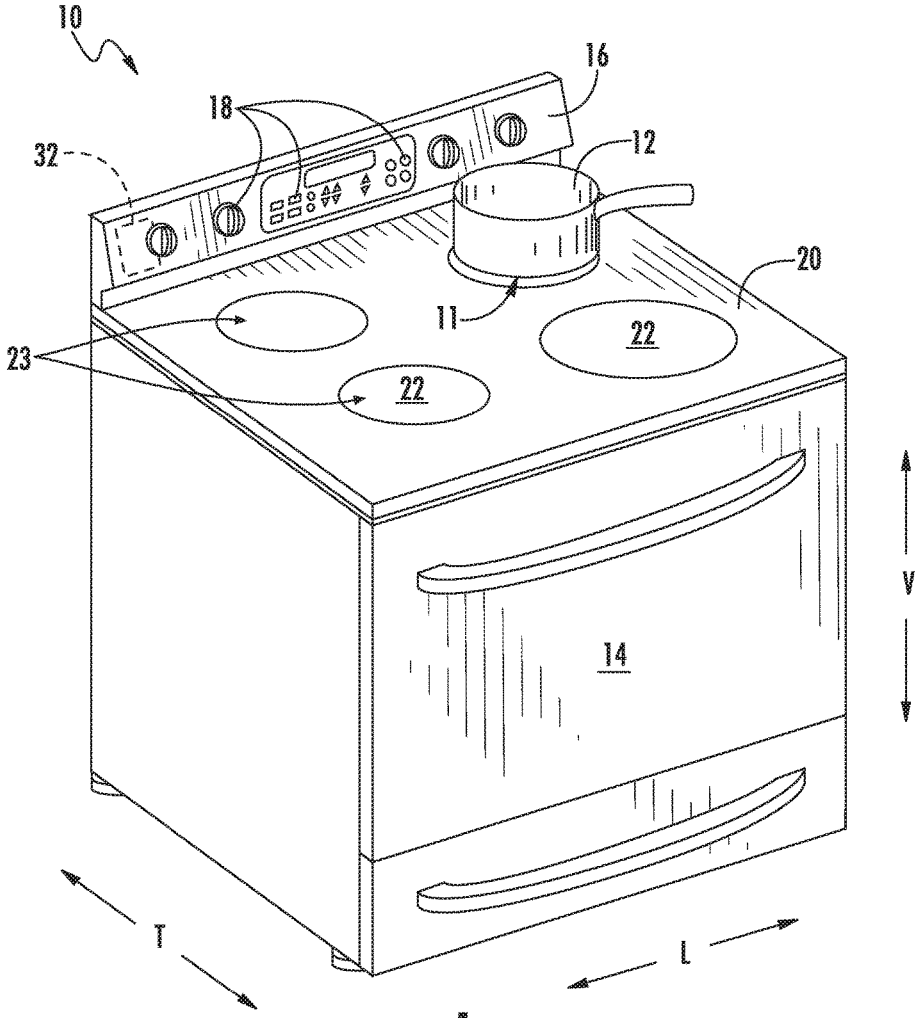
FIG. 1 provides a perspective view of a cooktop appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a cooktop appliance that includes at least one burner assembly. The burner assembly may have one or more radiant heating elements. The burner assembly may also have at least one relay switch and at least one thyristor that are electrically connected to the radiant heat element(s).

Turning now to the figures, FIG. 1 provides a perspective view of an exemplary cooktop appliance 10. Generally, cooktop appliance 10 defines a vertical direction V, a lateral direction L, and a transverse direction T. Each of the vertical direction V, lateral direction L, and transverse direction T may be mutually orthogonal to each other. As illustrated in FIG. 1, cooktop appliance 10 may be a range appliance that includes a horizontal cooking surface 20 disposed on and/or vertically above an oven cabinet. However, cooktop appliance 10 is provided by way of example only and is not intended to limit the present subject matter in any aspect. Thus, the present subject matter may be used with other cooktop appliance configurations, e.g., cooktop appliances without an oven. Further, the present subject matter may be used in any other suitable appliance.

Cooking surface 20 of cooktop appliance 10 includes one or more heating assemblies 22 having at least one burner 23. Cooking surface 20 may be constructed of any suitable material, e.g., a ceramic, enameled steel, or stainless steel. As shown in FIG. 1, a cooking utensil 12, such as a pot, kettle, pan, skillet, or the like, may be placed or positioned on a heating assembly 22 to cook or heat food items placed within the cooking utensil 12. In some embodiments, cooktop appliance 10 includes a door 14 that permits access to a cooking chamber (not shown) of the oven cabinet of appliance 10, the cooking chamber for cooking or baking of food or other items placed therein. Exemplary embodiments include a user interface 16 having one or more control inputs 18 permits a user to make selections for cooking of food items using heating assemblies 22 and/or the cooking chamber. As an example, a user may manipulate one or more control inputs 18 to select, e.g., a power or heat output setting for each heating assembly 22, as will be described below. The selected heat output setting of heating assembly 22 affects the heat transferred to cooking utensil 12 positioned on heating assembly 22. Although shown on a backsplash or back panel of cooktop appliance 10, user interface 16 may be positioned in any suitable location, e.g., along a front edge of the appliance 10. Control inputs 18 may include one or more buttons, knobs, or touch screens, as well as combinations thereof.

Figure 2:
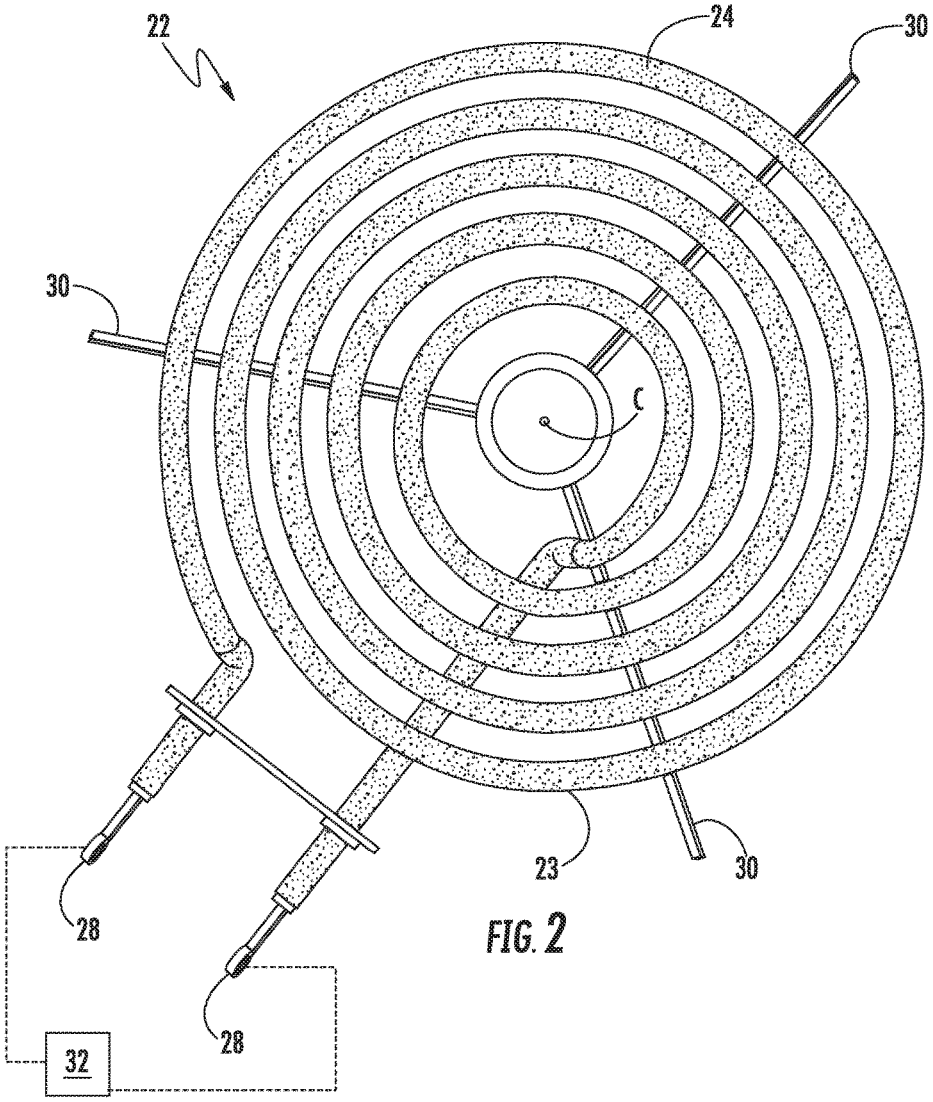
FIG. 2 provides a top, perspective view of a heating assembly according to an exemplary embodiment of the present disclosure.
Figure 3:
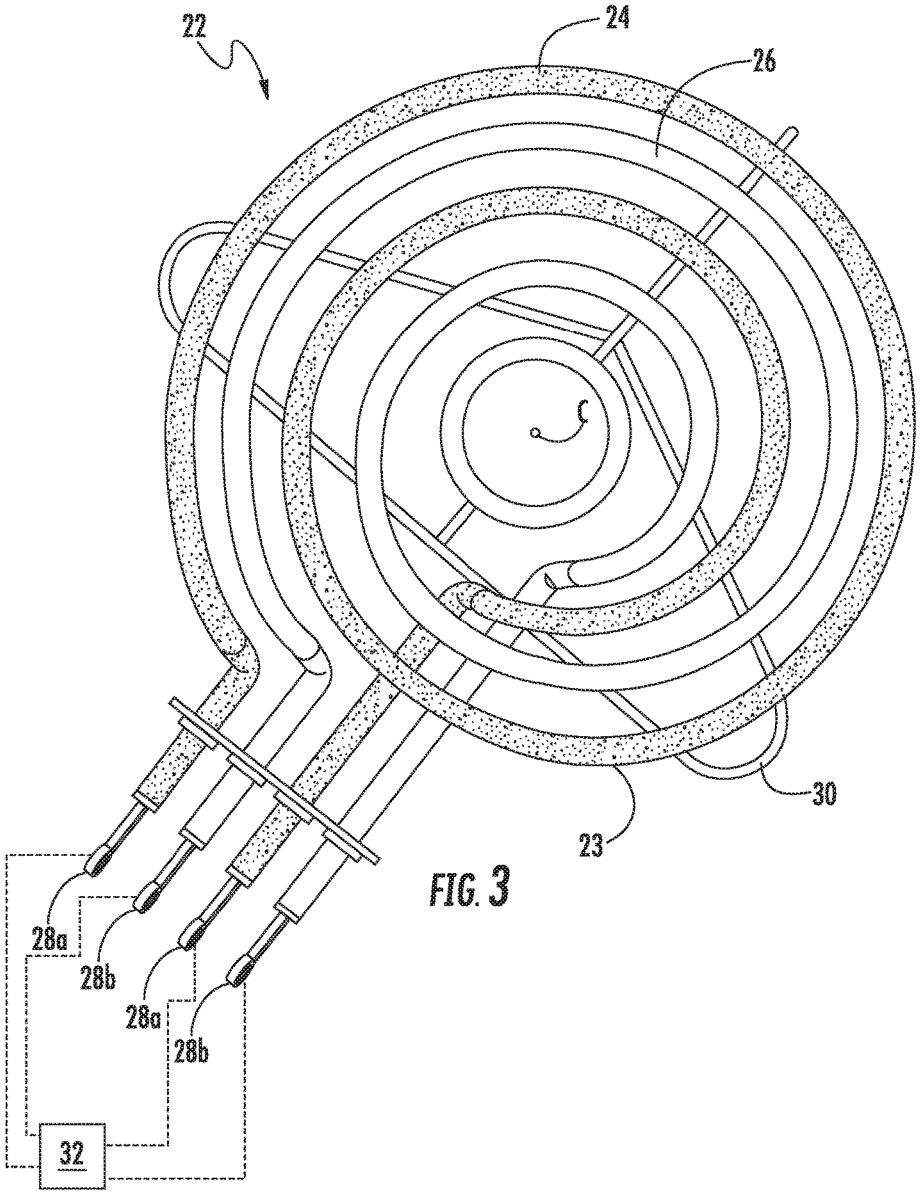
FIG. 3 provides a top, perspective view of another heating assembly according to an exemplary embodiment of the present disclosure.
Figure 4:
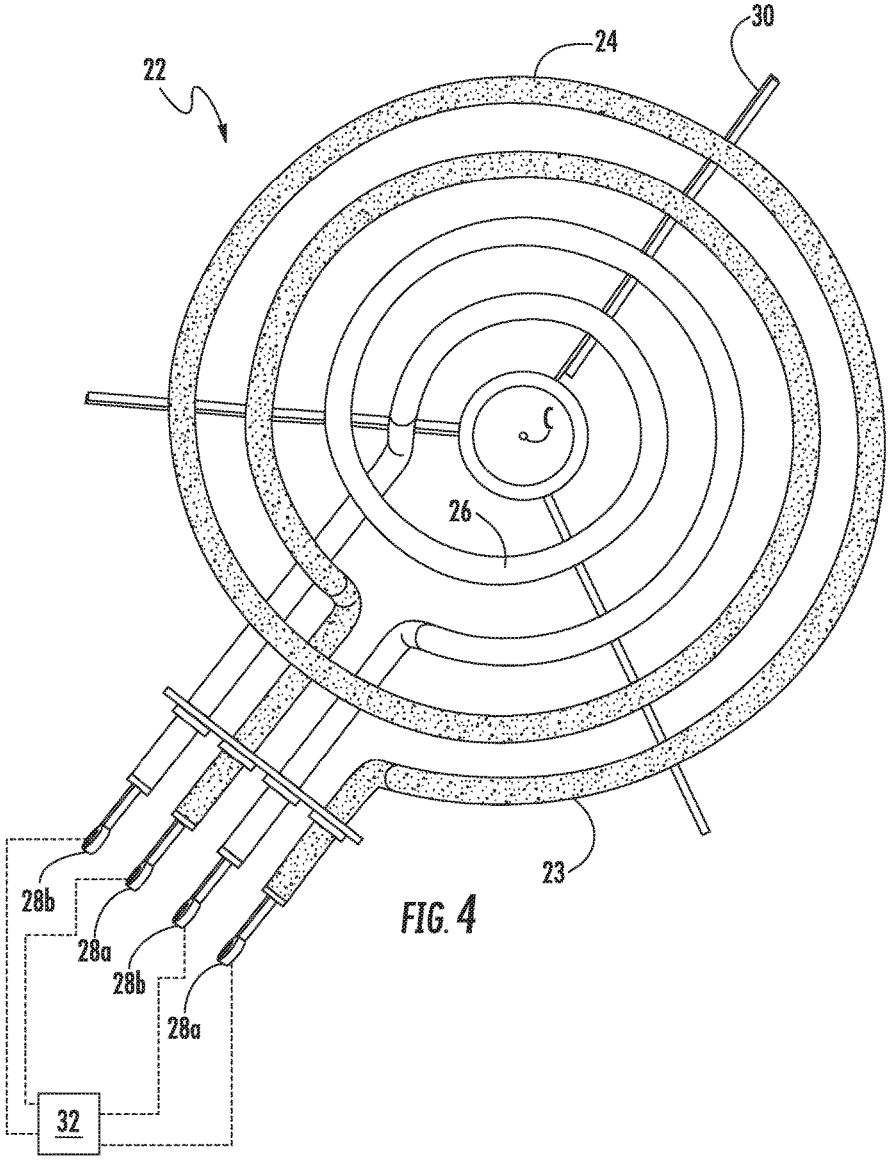
FIG. 4 provides a top, perspective view of another heating assembly according to an exemplary embodiment of the present disclosure.

FIGS. 2 through 4, provide overhead views of various exemplary heating assembly 22 embodiments. As illustrated in FIG. 2, some exemplary heating assembly 22 embodiments include a burner 23 having a single radiant heat element 24. For instance, radiant heat element 24 may be a spiral shaped electrical resistive heating element for providing heat to a cooking utensil 12 positioned thereon. In some such embodiments, heating assembly 22 utilizes exposed, electrically-heated, planar coils that are helically-wound about center point C. Coils act as a heat source, i.e., as radiant heat element 24, for heating cooking utensils 12 placed directly on heating assembly 22. Optionally, each heating assembly 22 of cooking appliance 10 may be heated by the same type of heat element 24, or cooking appliance 10 may include a combination of different types of heating sources. Further, heating assemblies 22 may have any suitable shape and size, and cooking appliance 10 may include a combination of heating assemblies 22 of different shapes and sizes.

Referring still to FIG. 2, heating assembly 22 includes two terminals 28 for first radiant heat element 24. Terminals 28 provide power, i.e., a voltage V, from a power source (not shown) to the heat element 24 of heating assembly 22. Additionally or alternatively, heat element 24 may be in operable communication with a controller 32 or other control mechanism via terminals 28. As will be understood, by providing heat element 24 with terminals 28, heating assembly 22 may be selectively attached/disconnected from the power source and from cooking appliance 10, e.g., to reposition the heating assembly 23, to remove the heating assembly 22 for cleaning cooking surface 20, or the like.

Also as shown, heating assembly 22 may be supported on one or more support elements 30, which also help support cooking utensil 12 when the cooking utensil 12 is placed on heating assembly 22. Further, although illustrated as forming a spiral shape by winding in coils around a center point C, radiant heat element 24 may have a different number of turns, other shapes, or other configurations as well.

As illustrated in FIG. 3, some exemplary heating assembly 22 embodiments include a multiple radiant heat elements, such as a first radiant heat element 24 and a second radiant heat element 26. It will be understood that, as in FIG. 2, first radiant heat element 24 is shaded for purposes of clarity only and, at least externally, need not be visually different from second radiant heat element 26. In exemplary embodiments, such as that shown in FIG. 3, both radiant heat elements 24, 26 are coiled about center point C. The coils of first radiant heat element 24 alternate with the coils of second radiant heat element 26 such that the coils of first and second radiant heat elements 24, 26 are intertwined about the center point C. Stated differently, the coils of first radiant heat element 24 alternate with coils of second radiant heat element 26 such that a coil of second radiant heat element 26 is positioned between the coils of first radiant heat element 24 as the heat elements wind around center point C. In other words, second radiant heat element 26 and first radiant heat element 24 are co-wound in a spiral about common center point C. Each radiant heat element 24, 26 may include a discrete pair of terminals 28*a*, 28*b* similar to those described above.

In FIG. 4, another heating assembly 22 embodiment is illustrated. Similar to the exemplary embodiment of FIG. 3, the exemplary embodiment of FIG. 4 includes a first radiant heat element 24 and a second radiant heat element 26. Both radiant heat elements 24, 26 are coiled about center point C. More particularly, second radiant heat element 26 is configured as a helical coil or spiral about center point C, and first radiant heat element 24 likewise may be configured as a helical coil or spiral about center point C, with second radiant heat element 26 positioned within a space between center point C and first radiant heat element 24. Stated differently, a length of second radiant heat element 26 may be coiled about center point C, and a length of first radiant heat element 24 may be coiled about second radiant heat element 26, with center point C central to the coils of first radiant heat element 24. In other words, second radiant heat element 26 is concentric with and surrounded by first radiant heat element 24.

Returning to FIG. 1, some embodiments further include a controller 32 operably connected, e.g., electrically coupled, to user interface 16. Generally, operation of cooking appliance 10, including heating assemblies 22, may be controlled by controller 32. In some embodiments, controller 32 is a processing device and may include a microprocessor or other device that is in operable communication with components of appliance 10, such as heating assembly 22. Controller 32 may include a memory and microprocessor, such as a general or special purpose microprocessor operable to execute programming instructions or micro-control code associated with a selected heating level, operation, or cooking cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 32 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Control inputs 18 and other components of cooking appliance 10 may be in communication with (e.g., electrically coupled to) controller 32 via one or more signal lines or shared communication busses. First radiant heat element 24 and/or second radiant heat element 26 may be operably connected to controller, e.g., at respective terminal pairs 28*a*, 28*b*.

Figure 5:
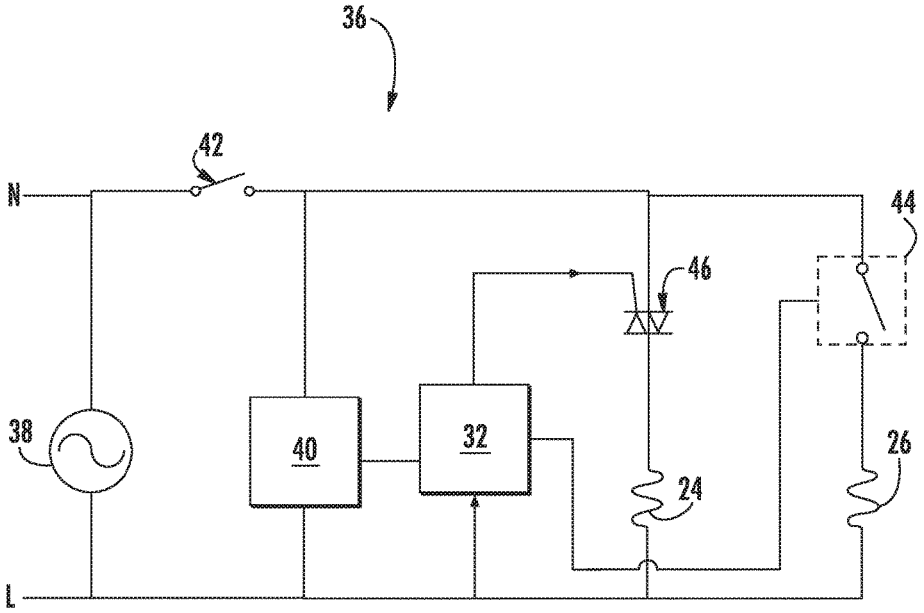
FIG. 5 provides a schematic view of a heating circuit according to an exemplary embodiment of the present disclosure.
Figure 6:
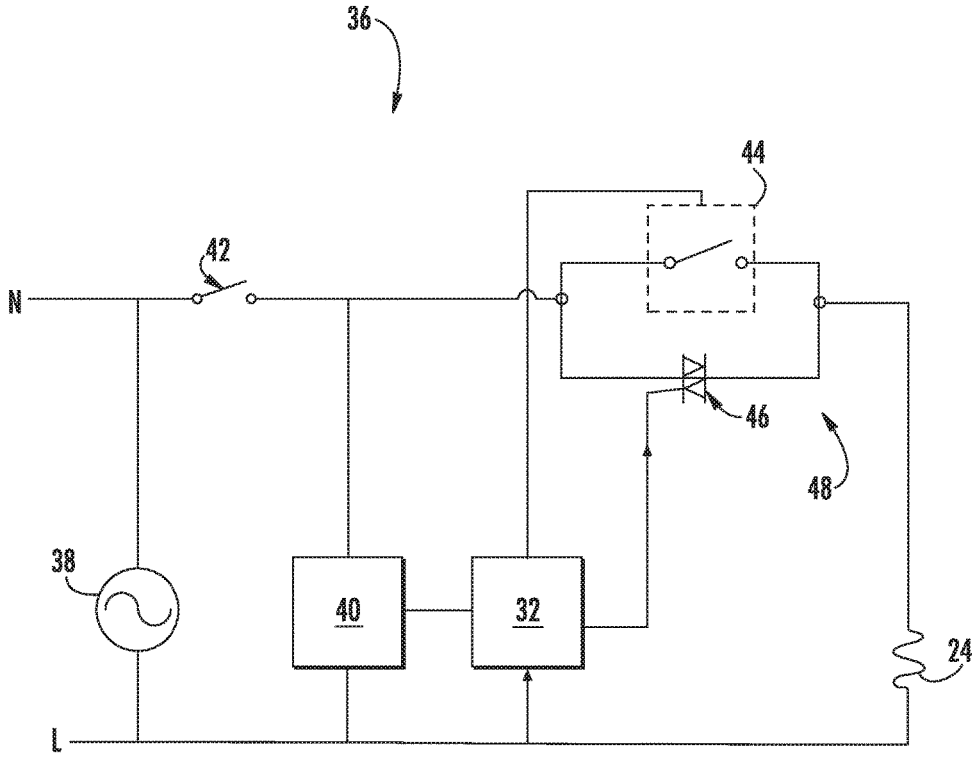
FIG. 6 provides a schematic view of another heating circuit according to an exemplary embodiment of the present disclosure.

Turning now to FIGS. 5 and 6, exemplary heating circuit 36 embodiments are provided. In some embodiments of appliance 10, one or more of the exemplary heating circuits 36 are included and operably connect various components, e.g., controller 32 and heating assembly 22. As illustrated, a power source 38 provides an input voltage to a heating circuit 36. A power supply 40 may configured to receive voltage from power source 38 through a neutral line switch 42, and to supply a voltage, e.g., a DC voltage, to controller 32 to provide operating power for controller 32.

As noted above, heating assembly 22 includes at least one radiant heat element 24 operably connected to power supply 40. User interface 16 (see FIG. 1) may be connected to controller 32, and through controller 32, to at least one relay switch 44 and one thyristor 46. Relay switch 44 may be an electromechanical relay, such as a bimetallic relay switch. Thyristor 46 may be a TRIAC. Additionally or alternatively, another suitable relay, such as a non-actuating solid state relay may be included with thyristor 46. Each of relay switch 44 and thyristor 46 may be electrically coupled to a separate radiant heat element 24, 26 to conduct a current thereto.

Controller 32 may generally be configured to control relay switch 44 and thyristor 46 to selectively conduct a current/voltage therethrough. For instance, in embodiments wherein a TRIAC is used, at least a portion of a zero cross signal can be applied to a controller 32 (e.g., at an input). In response, controller 32 may control a gate of the TRIAC (e.g., at an output of controller 32). Controller 32 may use the applied portion of the zero cross signal to determine a number of A/C cycles to skip in between drawing current from the TRIAC gate to activate or energize the load. TRIAC may be triggered or activated at one or more predetermined points in an A/C cycle to vary the power that is delivered therethrough. Different heat levels generated at a connected radiant heat element (e.g., first radiant heat element 24) may be determined or set by combining active A/C cycles and skipped A/C cycles, e.g., according to a predetermined cycle skipping pattern. Each heat level may correspond to a unique cycle skipping pattern.

In some embodiments, such as the exemplary embodiment of FIG. 5, relay switch 44 and thyristor 46 are disposed in electrical communication with separate radiant heat elements 24, 26. Thyristor 46 is electrically coupled in series between power source 38 and first radiant heat element 24. Current is thus directed to first radiant heat element 24, energizing first radiant heat element 24, only when permitted through thyristor 46. Heat generated at radiant heat element 24 may regulated according to the current transmitted through thyristor 46, e.g., the average current applied over a cycle skipping pattern. Relay switch 44 is electrically coupled in series between power source 38 and second radiant heat element 26. Current is thus directed to second radiant heat element 26, energizing second radiant heat element 26, only when permitted through relay switch 44. In other words, second radiant heat element 26 is only activated when relay switch 44 is closed. Moreover, first radiant heat element 24 and second radiant heat element 26 may be activated independently of each other according to the state of the thyristor 46 and relay switch 44, respectively.

In optional embodiments, user interface 16 and controller 32 are operably connected with thyristor 46 and relay switch 44. Controller 32 may be configured to selectively control thyristor 46 and relay switch 44 in order to determine the heat or temperature at heating assembly 22, e.g., in accordance with signals or commands from user interface 16. For instance, controller 32 may be configured to receive one or more input signals from user interface 16. Upon receiving an input signal, controller 32 may determine a heating condition, e.g., a voltage value for heating assembly 22, based at least in part on a received input signal. Controller 32 may then activate one of or both of thyristor 46 and relay switch 44 according to the determined heating condition.

Input signals may generally correspond to desired operations or characteristics requested by a user, e.g., requested through interactions with user interface 16 (see FIG. 1). For instance, an input signal may include a desired heat signal, such as a low heat signal, a high heat signal, or a select temperature signal. Additionally or alternatively, input signal may include a desired operation mode signal. The heat signal and/or the operation mode signal may influence the determined heating condition. In turn, the heat setting and/or the operation mode may at least partially dictate how and when thyristor 46 and/or relay switch 44 are activated.

In optional embodiments, controller 32 is configured to control heat output at first radiant heat element 24 and second radial heat element 26 based on received input signals. Controller 32 may only activate one of first radiant heat element 24 or second radiant heat element 26 if controller 32 determines a heating condition has been met. For instance, heating condition may indicate that a heat threshold (e.g., heat output or temperature value) will be met. In some such embodiments, determination of a heating condition includes determination of one of a low heat setting or a high heat setting. If the heating condition, e.g., the desired heat at heating assembly 22, is determined to be below a predetermined threshold, controller 32 may determine a low heat setting is appropriate. Conversely, if the heating condition is determined to be above a predetermined threshold, controller 32 may determine a high heat setting is appropriate. In certain embodiments, relay switch 44 is activated in response to a low heat setting. Both relay switch 44 and thyristor 46 may be activated in response to a high heat setting. In alternative embodiments, thyristor 46 is activated in response to a low heat setting. Both thyristor 46 and relay switch 44 may be activated in response to a high heat setting.

In some embodiments, determination of a heating condition by controller 32 may include determination of an operation mode. Optionally, a plurality of operation modes may be provided, e.g., within memory of controller 32. A user may selectively initiate one of the plurality of modes according to a desired performance of the heating assembly 22. Controller 32 may determine an operation mode based on user input signal(s). In some such embodiments, a lifespan-conservation mode may be provided. In lifespan-conservation mode, activation of thyristor 46 may be prioritized over relay switch 44. For instance, relay switch 44 may only be activated once controller 32 has determined that heat from solely first radiant heat element 24 would be inadequate to meet the demands of heating assembly 22. In additional or alternative embodiments, an energy-conservation mode may be provided. In energy-conservation mode, activation of relay switch 44 may be prioritized over thyristor 46. For instance, thyristor 46 may only be activated once controller 32 has determined that heat solely from second radiant heat element 26 would be inadequate to meet the demands of heating assembly 22. In further additional or alternative embodiments, a silent operation mode may be provided. In silent operation mode, activation of relay switch 44 may be restricted such that no noise is generated by the cycling thereof.

In certain embodiments, such as the exemplary embodiment of FIG. 6, a relay control 48 is operably connected to user interface 16 (see FIG. 1). Relay control 48 may be electrically coupled in series between power source 38 and a radiant heat element 24. As illustrated, relay control 48 includes thyristor 46 and relay switch 44, coupled to each other in parallel. Current is thus directed to radiant heat element 24 from power supply 40 through thyristor 46 and/or relay switch 44.

Controller 32 may be configured to selectively control thyristor 46 and relay switch 44 to dictate the heat or temperature at heating assembly 22, e.g., in accordance with signals or commands from user interface 16. For instance, controller 32 may be configured to receive one or more input signals from user interface 16. Upon receiving an input signal, controller 32 may determine a heating condition, e.g., a voltage value for heating assembly 22, based at least in part on the received input signal. Controller 32 may then activate one of or both of thyristor 46 and relay switch 44 according to the determined heating condition.

Input signals may generally correspond to desired operations or characteristics requested by a user, e.g., requested through interactions with user interface 16 (see FIG. 1). For instance, an input signal may include a desired heat signal, such as a low heat signal, a high heat signal, or a select temperature signal. Additionally or alternatively, input signal may include a desired operation mode signal. The heat signal and/or the operation mode signal may influence the determined heating condition. In turn, the heat setting and/or the operation mode may at least partially dictate how and when thyristor 46 and/or relay switch 44 are activated.

In optional embodiments, controller 32 is configured to control heat output at radiant heat element 24 based on received input signals. Controller 32 may only activate one of thyristor 46 or relay switch 44 if controller 32 determines a heating condition has been met. For instance, heating condition may indicate that a heat threshold (e.g., heat output or temperature value) will be met. In some such embodiments, determination of a heating condition includes determination of one of a low heat setting or a high heat setting. If the heating condition, e.g., the desired heat at heating assembly 22, is determined to be below a predetermined threshold, controller 32 may determine a low heat setting is appropriate. Conversely, if the heating condition is determined to be above a predetermined threshold, controller 32 may determine a high heat setting is appropriate. In certain embodiments, relay switch 44 is activated in response to a low heat setting. Both relay switch 44 and thyristor 46 may be activated in response to a high heat setting. In alternative embodiments, thyristor 46 is activated in response to a low heat setting. Both thyristor 46 and relay switch 44 may be activated in response to a high heat setting.

Optionally, multiple intermediate heat settings may be provided within the range of the low heat setting and/or the high heat setting. Intermediate settings within the low heat setting may all be less than a predetermined threshold (e.g., such that the intermediate settings include 10%, 20%, 30%, 40%, and 50% power settings). Intermediate settings within the high heat setting may all be greater than a predetermined threshold (e.g., such that the intermediate settings include 60%, 70%, 80%, 90%, and 100% power settings). In some embodiments, thyristor 46 is selectively activated according to an intermediate setting. For instance, thyristor 46 may be activated in a cycle-skipping interval, e.g., based on the intermediate heat setting. A preset or predetermined lookup table, algorithm, and/or model may correlate specific cycle-skipping intervals to different intermediate settings. In exemplary embodiments, thyristor 46 is activated during all intermediate heat setting below a predetermined threshold, e.g., a 50% power. A unique cycle-skipping interval is provided for each intermediate heat setting below the predetermined threshold. Each interval may effectively limit the activation of thyristor 46, and thus vary the heat output by heating assembly 22. Additionally or alternatively, a different cycle-skipping interval may be provided for each intermediate heat setting above the predetermined threshold. Above the predetermined threshold, relay switch 44 may be fully activated while thyristor is activated according to the provided cycle-skipping intervals, thus varying heat output by heating assembly 22.

In some embodiments, determination of a heating condition by controller 32 may include determination of an operation mode. Optionally, a plurality of operation modes may be provided, e.g., within memory of controller 32. A user may selectively initiate one of the plurality of modes according to a desired performance of the heating assembly 22. Controller 32 may determine an operation mode based on user input signal(s). In some such embodiments, a lifespan-conservation mode may be provided. Activation of thyristor 46 may be prioritized over relay switch 44. For instance, relay switch 44 may only be activated once controller 32 has determined that heat generated at radiant heat element 24 solely from current through thyristor 46 would be inadequate to meet the demands of heating assembly 22. In additional or alternative embodiments, an energy-conservation mode may be provided. Activation of relay switch 44 may be prioritized over thyristor 46. For instance, thyristor 46 may only be activated once controller 32 has determined that heat generated at radiant heat element 24 solely from current through relay switch 44 would be inadequate to meet the demands of heating assembly 22. In further additional or alternative embodiments, a silent operation mode may be provided. Activation of relay switch 44 may be restricted such that no noise is generated by the cycling thereof.

Figure 7:
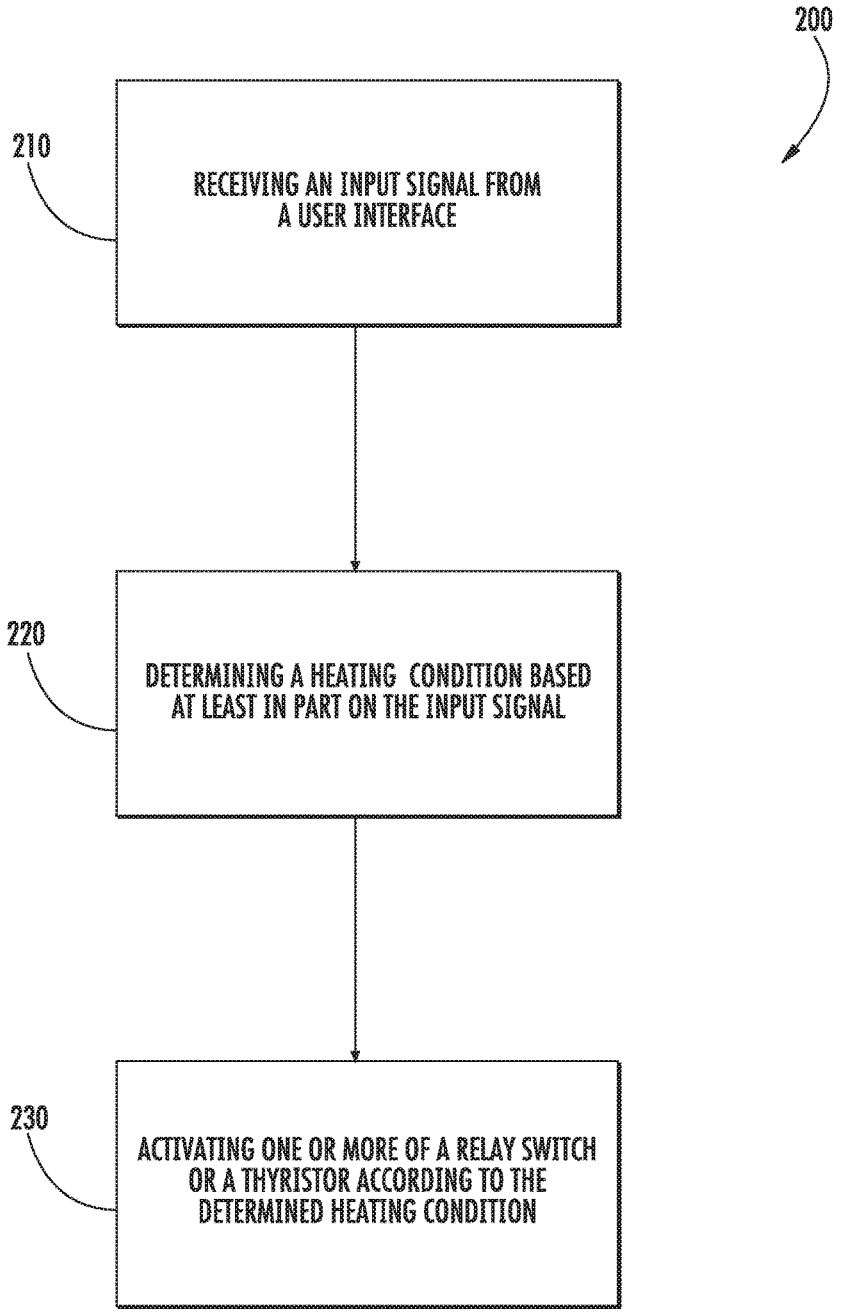
FIG. 7 provides a flow chart illustrating an exemplary method of operating a cooktop appliance according to an exemplary embodiment of the present disclosure.

Turning now to FIG. 7, a method 200 for operating a cooktop appliance according to an exemplary embodiment of the present disclosure is illustrated. Method 200 may be used to operate any suitable cooktop appliance. As an example, method 200 may be used to operate cooktop appliance 10 (see FIG. 1). Controller 32 (see FIG. 1) may be programmed to implement method 200.

At 210, method 200 includes receiving an input signal from a user interface. For instance, input signal may be transmitted in response to interactions or engagement from user with user interface, e.g., at a button or touch screen. As described above, input signals may generally correspond to desired operations or characteristics requested by a user, e.g., through interactions with user interface.

At 220, method 200 includes determining a heating condition. Determinations may be based at least in part on a received input signal at 210. Optionally, 220 may include determining one of a low heat setting or a high heat setting. Additionally or alternatively, 220 may include determining an operation mode. For instance, 220 may include determining an energy-conservation mode, lifespan-conservation mode, and/or silent operation mode, as described above.

At 230, method 200 includes activating one or more of a relay switch or a thyristor. Activation may be executed or initiated according to the determined heating condition. Activating the relay switch may energize the second radiant heat element. Activating the thyristor may energize the first radiant heat element. Optionally, 230 may include activating the relay switch upon determining the low heat setting, and activating the relay switch and the thyristor upon determining the high heat setting. Alternatively, 230 may include activating the relay switch upon determining the low heat setting, and activating the relay switch and the thyristor upon determining the high heat setting.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a user interface;

a power source operably connected to the user interface;

a burner including a first radiant heat element and a second radiant heat element electrically coupled in parallel to the power source;

a thyristor operably connected to the user interface and electrically coupled in series between the power source and the first radiant heat element to control activation of the first radiant heat element;

a relay switch operably connected to the user interface and electrically coupled in series between the power source and the second radiant heat element to control activation of the second radiant heat element; and a controller operably connected to the user interface, the thyristor, and the relay switch, wherein the controller is configured to receive an input signal from the user interface, determine a heating condition based at least in part on the input signal received from the user interface, and activate one or more of the relay switch or the thyristor according to the determined heating condition, wherein determination of a heating condition includes determination of one of a low heat setting or a high heat setting, wherein activation of one or more of the relay switch or the thyristor includes activation of only one of the relay switch or the thyristor upon determination of the low heat setting, wherein the other of the relay switch or the thyristor is restricted from activation in the low heat setting, and wherein activation of one or more of the relay switch or the thyristor includes activation of the relay switch and the thyristor upon determination of the high heat setting.

2. The cooktop appliance of claim 1, wherein a length of the first radiant heat element is coiled about a center point to include a plurality of coils and a length of the second radiant heat element is coiled about the center point to include a plurality of coils, and wherein the coils of the first radiant heat element alternate with the coils of the second radiant heat element such that the coils of the first and second radiant heat elements are intertwined about the center point.

3. The cooktop appliance of claim 1, wherein a length of the first radiant heat element is coiled about a center point to include a plurality of coils and a length of the second radiant heat element is coiled about the center point to include a plurality of coils, and wherein the coils of the first radiant heat element are positioned radially outward from the coils of the second radiant heat element such that the coils of the first and second radiant heat elements are discrete concentric rings about the center point.

4. The cooktop appliance of claim 1, wherein activation of one or more of the relay switch or the thyristor includes activation of the relay switch upon determination of the low heat setting.

5. The cooktop appliance of claim 1, wherein activation of one or more of the relay switch or the thyristor includes activation of the thyristor upon determination of the low heat setting.

6. The cooktop appliance of claim 1, wherein the thyristor includes a TRIAC.

7. A cooktop appliance comprising:

a user interface;

a power source operably connected to the user interface;

a burner including a radiant heat element electrically coupled to the power source;

a relay control operably connected to the user interface, the relay control including a thyristor and a relay switch, the thyristor and the relay switch coupled in parallel, the relay control being positioned in series between the power source and the radiant heat element to control activation of the radiant heat element; and a controller operably connected to the user interface, the thyristor, and the relay switch, wherein the controller is configured to receive an input signal from the user interface, determine a heating condition based at least in part on the input signal received from the user interface, and activate one or more of the relay switch or the thyristor according to the determined heating condition, wherein determination of a heating condition includes determination of one of a low heat setting or a high heat setting, wherein activation of one or more of the relay switch or the thyristor includes activation of only one of the relay switch or the thyristor upon determination of the low heat setting, wherein the other of the relay switch or the thyristor is restricted from activation in the low heat setting, and wherein activation of one or more of the relay switch or the thyristor includes activation of the relay switch and the thyristor upon determination of the high heat setting.

8. The cooktop appliance of claim 7, wherein activation of one or more of the relay switch or the thyristor includes activation of the relay switch upon determination of the low heat setting.

9. The cooktop appliance of claim 7, wherein activation of one or more of the relay switch or the thyristor includes activation of the thyristor upon determination of the low heat setting, and wherein activation of one or more of the relay switch or the thyristor includes activation of the relay switch and the thyristor upon determination of the high heat setting.

10. The cooktop appliance of claim 7, wherein the thyristor includes a TRIAC.

11. A method of operating a cooktop appliance comprising a burner including a first radiant heat element and a second radiant heat element, the first radiant heat element being electrically coupled to the second radiant heat element in parallel, the cooktop appliance further comprising a thyristor electrically coupled in series to the first radiant heat element and a relay switch electrically coupled in series to the second radiant heat element, the method comprising:

receiving an input signal from a user interface;

determining a heating condition based at least in part on the input signal; and activating one or more of the relay switch to energize the second radiant heat element or the thyristor to energize the first radiant heat element, wherein the activating one or more of the relay switch or the thyristor is initiated according to the determined heating condition, wherein determining a heating condition includes determining one of a low heat setting or a high heat setting, wherein activating one or more of the relay switch or the thyristor includes activating only one of the relay switch or the thyristor upon determining the low heat setting, wherein the other of one of the relay switch or the thyristor is restricted from activating in the low heat setting, and wherein activating one or more of the relay switch or the thyristor includes activating the relay switch and the thyristor upon determining the high heat setting.

12. The method of claim 11, wherein activating one or more of the relay switch or the thyristor includes activating the relay switch upon determining the low heat setting, and activating the relay switch and the thyristor upon determining the high heat setting.

13. The method of claim 12, wherein determining a heating condition further includes determining an energy-conservation mode.

14. The method of claim 11, wherein activating one or more of the relay switch or the thyristor includes activating the relay switch upon determining the low heat setting, and activating the relay switch and the thyristor upon determining the high heat setting.

15. The method of claim 14, wherein determining a heating condition further includes determining a lifespan-conservation mode.

* * * * *